US006292182B1

(12) United States Patent
Park et al.

(10) Patent No.: US 6,292,182 B1
(45) Date of Patent: Sep. 18, 2001

(54) LIQUID CRYSTAL DISPLAY MODULE DRIVING CIRCUIT

(75) Inventors: Jin San Park; Soo Woong Hwang, both of Songnam; Hyun Kwan Lee, Seoul, all of (KR)

(73) Assignee: Hyundai Electronics Industries Co., Ltd., Kyoungki-do (KR)

( * ) Notice: Subject to any disclaimer, the term of this patent is extended or adjusted under 35 U.S.C. 154(b) by 0 days.

(21) Appl. No.: 09/104,719

(22) Filed: Jun. 25, 1998

(30) Foreign Application Priority Data

Jun. 25, 1997 (KR) ..... 97-27436
Jun. 30, 1997 (KR) ..... 97-30438
Jun. 30, 1997 (KR) ..... 97-30439

(51) Int. Cl.[7] ..... G09G 5/00
(52) U.S. Cl. ..... 345/211; 340/825.31
(58) Field of Search ..... 345/95, 98, 99, 345/100, 211, 212, 213; 340/825.31

(56) References Cited

U.S. PATENT DOCUMENTS 4,922,448 * 5/1990 Kunieda et al. ..... 364/900
4,931,791 * 6/1990 Mallard, Jr. ..... 340/825.5
5,155,477 * 10/1992 Shirochi ..... 340/784
5,227,614 * 7/1993 Danielson et al. ..... 235/380
5,563,624 10/1996 Imamura ..... 345/100
5,659,680 * 8/1997 Cunningham et al. ..... 395/183.01
5,708,840 * 1/1998 Kikinis et al. ..... 395/800
5,992,318 * 11/1999 DiBello et al. ..... 101/181

* cited by examiner

*Primary Examiner*—Bipin Shalwala
*Assistant Examiner*—Vanel Frenel
(74) *Attorney, Agent, or Firm*—Selitto, Behr & Kim

(57) ABSTRACT

A circuit for driving a LCM, comprising: a power supply portion for receiving an external voltage of 12V to generate internal voltages of 3.3V and 5V; a clock generation portion for generating a clock signal of desired frequency; a driving signal generation portion for receiving the clock signal from the clock generation portion to generate driving signals of a data enable signal, a horizontal synchronous signal, a vertical synchronous signal, and an enable signal; a signal selection portion for selecting the desired signals of the driving signals from the driving signal generation portion and outputting the selected driving signals and the clock signal from the clock generation portion; a state detection portion for receiving the vertical synchronous signal and the external voltage of 5V to detect a normal operation state of the LCM; a power selection portion for selecting one of an external voltage of 5V and the external voltage of 12V in accordance with application of the internal voltage of 5V; and an output portion for outputting the selected driving signals and clock signal from the signal selection portion, the selected power voltage from the power selection portion and a state detection signal from the state detection portion.

33 Claims, 5 Drawing Sheets

LIQUID CRYSTAL DISPLAY MODULE DRIVING CIRCUIT

BACKGROUND OF THE INVENTION

This invention relates to a circuit for driving liquid crystal display module (LCM), and more particularly to a LCM driving circuit for generating signals for test of LCMS. In particular, the invention relates to an LCM driving circuit for generating signals for pattern display used in a module assembly in-line in aging test and panel test for measuring reliability of LCMs.

In general, the prior LCM driving circuit has been designed so as to drive only the LCM of the predetermined mode. Therefore, in case where the mode of LCM is changed, because the LCD driving circuit suitable to the predetermined mode must be designed and then manufactured anew, it is very poor economy. The prior LCM driving circuit has driven LCM to display only fixed black pattern as a test pattern on a liquid crystal display(LCD) panel in aging test. That is, during the aging test, the prior LCM driving circuit generates the driving signals for displaying one fixed black pattern to drive the LCM, thereby resulting in displaying only black pattern on the LCD panel. Accordingly, it is impossible for the prior driving circuit to generate driving signals for display alternately black and white patterns at intervals of the desired period, for example at intervals of 2 to 3 seconds on the LCD panel during aging test. Furthermore, the prior driving circuit for aging test is not capable of providing power supply of 3.3V to LCM having use for power supply of 3.3V.

SUMMARY OF THE INVENTION

An object of the present invention is to provide a LCM driving circuit which generates driving signals for displaying a pattern for aging test regardless of a LCM operation mode.

Another object of the present invention is to provide a LCM driving circuit applicable to an enable mode and a synchronous mode.

Yet another object of the present invention is to provide a LCM driving circuit capable of providing power supply of 3.3V or 5V to a LCM.

A further object of the present invention is to provide a LCM driving circuit which generates driving signals capable of displaying black and white patterns at intervals of a desired period.

According to an aspect of the present invention, there is provided a circuit for driving a LCM, comprising: a power supply portion for receiving an external voltage of 12V to generate internal voltages of 3.3V and 5V; a clock generation portion for generating a clock signal of desired frequency; a driving signal generation portion for receiving the clock signal from the clock generation portion to generate driving signals of a data enable signal, a horizontal synchronous signal, a vertical synchronous signal, an enable signal; a signal selection portion for selecting the desired signals of the driving signals from the driving signal generation portion and outputting the selected driving signals and the clock signal from the clock generation portion; a state detection portion for receiving the vertical synchronous signal and the external voltage of 5V to detect a normal operation state of the LCM; a power selection portion for selecting one of an external voltage of 5V and the external voltage of 12V in accordance with application of the internal voltage of 5V; and an output portion for outputting the selected driving signals and clock signal from the signal selection portion, the selected power voltage from the power selection portion, the clock signal from the clock generation portion and a state detection signal from the state detection portion.

The LCM driving circuit further comprises a circuit protection portion for protect the driving circuit by selecting an external voltage when the external voltage and an internal voltage are simultaneously applied to the driving circuit, which includes a first protection portion for selecting the external voltage of 12V when the internal voltage of 12V and an external voltage of 12V are simultaneously applied and a second protection portion for selecting the external voltage of 5V when the external voltage of 5V and the internal 5V are simultaneously applied.

The clock generation portion generates a clock signal having one of 25.175 MHz, 40 MHz or 65 MHz. The power supply portion includes a first generation portion for receiving the external voltage of 12V to generate the internal voltage of 5V; and a second generation portion for receiving the external voltage of 12V to generate the internal voltage of 3.3V.

The driving signal generation portion includes a counting portion for counting the clock signal from the clock generation portion; a data enable signal generation portion for receiving outputs of the counting portion to generate the data enable signal; a horizontal synchronous signal generation portion for receiving the data enable signal from the data enable signal generation portion to generate the horizontal synchronous signal; a vertical synchronous signal generation portion for receiving the data enable signal from the data enable signal generation portion to generate the vertical synchronous signal; an enable signal generation portion for receiving the data enable signal from the data enable signal generation portion and the vertical synchronous signal from the vertical synchronous signal generation portion to generate the enable signal; and a power stabilizing portion for stabilizing the internal voltage of 5V from the power supply portion which is provided to the data enable signal generation portion, the vertical synchronous signal generation portion and the horizontal synchronous signal generation portion.

The signal selection portion includes a transfer portion for transferring the driving signals from the driving signal generation portion and the clock signal from the clock generation portion; and a selection portion for selecting the desired signals of the driving signals from the driving signal generation portion according to operation mode of the LCM to be transferred to the output portion.

The power selection portion includes a first selection portion for providing the external voltage of 5V to the output portion in accordance with application of the internal voltage of 5V from the power supply portion; and a second selection portion for providing the external voltage of 12V to the output portion in accordance with application of the internal voltage of 5V. The first selection portion is comprised of an inverter for detecting application of the internal voltage of 5V from the power supply portion; a first transistor for providing the external voltage of 5V to the output portion according to detection result of the inverter; and a first and second resistors for supplying the external voltage of 5V to a base and collector of the first transistor, respectively. The second selection portion is comprised of a third and fourth resistors for dividing the internal voltage of 5V from the power supply portion; and a second transistor for providing the external voltage of 12V to the output portion in accordance with the divided voltage.

The state detection portion is comprised of an AND gate for receiving the vertical synchronous signal from the driving signal generation portion and the internal voltage of 5V from the power supply portion to detect the normal operation state of the LCM; and a transistor for providing a voltage of V in normal operation or the external voltage of 12V in abnormal operation to the output portion in accordance with an output of the AND gate.

According to another aspect of the present invention, there is provided to a circuit for driving a LCM, comprising: a power supply portion for receiving an external voltage of 12V to generate internal voltages of 3.3V and 5V; a clock generation portion for generating a clock signal CLK of 65 MHz and an inverted clock signal; a driving signal generation portion for receiving the clock signal from the clock generation portion to generate driving signals of a data enable signal of 800 CLK, a vertical synchronous signal of 600 H, an enable signal; a signal selection portion for selecting the desired signals of the driving signals from the driving signal generation portion and outputting the selected driving signals and the clock signal from the clock generation portion; a state detection portion for receiving the vertical synchronous signal and the external voltage of 5V to detect a normal operation state of the LCM; a power selection portion for selecting one of an external voltage of 5V and the external voltage of 12V in accordance with application of the internal voltage of 5V; a pattern selection portion for selecting one of a black pattern or a black and white pattern as a pattern being displayed on a LCD panel; and an output portion for outputting the selected driving signals and clock signal from the signal selection portion, the selected power voltage from the power selection portion, the clock signal from the clock generation portion and a state detection signal from the state detection portion.

The driving signal generation portion includes a counting portion for counting the clock signal from the clock generation portion; a data enable signal generation portion for receiving outputs of the counting portion to generate the data enable signal of 800 CLK; a vertical synchronous signal generation portion for receiving the data enable signal from the data enable signal generation portion to generate the vertical synchronous signal of 600 H; an enable signal generation portion for receiving the data enable signal from the data enable signal generation portion and the vertical synchronous signal from the vertical synchronous signal generation portion to generate the enable signal; and a power stabilizing portion for stabilizing the internal voltage of 5V from the power supply portion which is provided to the data enable signal generation portion, the vertical synchronous signal generation portion. The counting portion is comprised of a first counter which is triggered at a falling edge of the inverted clock signal from the clock generation portion to count the clock signal and generate first through twelfth output signals.

The data enable signal generation portion includes: a first NAND gate for receiving the ninth output signal of the first counter; a second NAND gate for receiving the sixth and eleventh output signals of the first counter; a first flip flop which receives an output signal of the first NAND gate as an input signal and is triggered at rising edge of the clock signal from the clock generation portion; a second flip flop which receives an output signal of the second NAND gate as an input signal, is triggered at rising edge of the clock signal and provides its inverted output signal to the first counter as a reset signal; and a third flip flop which receives output signals of the first and second flip flops as a preset signal and a clear signal, respectively and generates the data enable signal of 800 CLK as an output signal.

The vertical synchronous signal generation portion includes: a second counter which is triggered at falling edge of the data enable signal received from the data enable signal generation portion to count the data enable signal and generate first and twelfth output signals; a third NAND gate for receiving the third through fifth output signals of the second counter; a first AND gate for receiving the fifth and sixth output signals of the second counter; a second AND gate for receiving the seventh and tenth output signals of the second output signals; a fourth NAND gate for receiving output signals of the first and second AND gates and the third output signals of the second counter; an inverter for inverting the data enable signal generated from the data enable signal generation portion; a fourth flip flop which receives an output signal of the third NAND gate as an input and is triggered at rising edge of an inverted data enable signal received from the inverter; a fifth flip flop which receives an output signal of the fourth NAND gate as an input, is triggered at rising edge of the inverted data enable signal; and a sixth flip flop which receives output signals of the first and second flip flops as a preset signal and a clear signal, respectively and generates the vertical synchronous signal of 600 H as an output signal.

The enable signal generation portion includes a third AND gate for receiving the data enable signal from the data enable signal generation portion and the vertical synchronous signal from the vertical synchronous signal generation portion.

The signal selection portion includes; a transfer portion for transferring the data enable signal, the vertical synchronous signal and enable signal from the driving signal generation portion and the clock signal from the clock generation portion; and a selection portion for selecting the enable signal and clock signal from the transfer portion to provide them to the output portion. The transfer portion includes: an output buffer for receiving the data enable signal, the vertical synchronous signal and the enable signal from the driving signal generation portion; and a plural buffers for protection for transferring the enable signal and the vertical synchronous signal from the output buffer and the clock signal from the clock generation portion. The selection portion comprises a switch for selecting the enable signal and clock signal received from the transfer portion.

The pattern selection portion includes: a jumper switch for selecting the black and white pattern; a timer for adjusting the period of the black and white pattern selected by the jumper switch; and a flip flop which receives an output of the timer as an input signal and is triggered at rising edge of the data enable signal from the data enable signal generation portion to provide the period of the black and white pattern to the output portion.

According to further another aspect of the present invention, there is provided to a liquid crystal display module (LCM) driving circuit, comprising: a power supply portion for receiving an external 12V to generate an internal voltage of 5V and an internal voltage of 3.3V; a clock generation portion for generating a clock signal CLK of 25.175 MHz and an inverted clock signal; a driving signal generation portion for receiving the clock signal and the inverted clock signal to generate driving signals of a data enable signal of 640 CLK, a vertical synchronous signal of 480 H, a horizontal synchronous signal, and an enable signal; a signal selection portion for selecting the desired signals of the driving signals according to a operation mode of the LCM and providing the selected driving signals and the clock signal from the clock generation portion; a state detection portion for receiving the vertical synchronous signal and the external voltage of 5 to detect an operation state of the LCD driving circuit; a power selection portion for selecting the external voltage of 5V or the external voltage of 12V according to the application of the internal voltage of 5V; and an output portion for outputting the selected driving signals and the clock signal received from the signal selection portion, the power voltage selected from the power selection portion, and a state detection signal received from the state detection portion.

The driving signal generation portion includes: a counting portion which is triggered at a falling edge of the inverted clock signal from the clock generation portion to count the clock signal; a data enable signal generation portion for receiving output signals from the counting portion to generate the data enable signal of 640 CLK; a horizontal synchronous signal generation portion for receiving the output signals from the counting portion to generate the horizontal synchronous signal; a vertical synchronous signal generation portion for receiving the data enable signal from the data enable signal generation portion to generate the vertical synchronous signal of 480 H; an enable signal generation portion for receiving the data enable signal and the vertical synchronous signal to the enable signal; and a stabilizing means for stabilizing the internal voltage of 5V which is provided to the data enable signal generation portion, vertical synchronous signal generation portion and the horizontal synchronous signal generation portion.

The counting portion includes a first counter which is triggered at a falling edge of the inverted clock signal from the clock generation portion to counter the clock signal and providing first and twelfth output signals. The data enable signal generation portion includes: a first NAND gate for receiving the sixth out signal and the eighth output signal received from the first counter; a second NAND gate for receiving the sixth out signal, the ninth output signal and the tenth output signal received from the first counter; a first flip flop which receives the output signal of the first NAND gate as an input signal and is triggered at a rising edge of the clock signal from the clock generation portion; a second flip flop which receives the output signal of the second NAND gate and is triggered at a rising edge of the clock signal from the clock generation portion and generates its inverted output signal to the first counter of the counting portion as a reset signal; and a third flip flop which receives output signals of the first and second flip flops as a preset signal and a clear signal and generates the data enable signal of 640 CLK. The horizontal synchronous signal generation portion includes: a third NAND gate for receiving the sixth out signal and the seventh output signal received from the first counter; a fourth flip flop which receives an output signal of the third NAND gate as an input signal and is triggered at a rising edge of the clock signal from the clock generation portion; and a fifth flip flop which receives output signals of the fourth and second flip flops as a preset signal and a clear signal and generates the horizontal synchronous signal as an output signal.

The vertical synchronous signal generation portion includes: a second counter which is triggered at a falling edge of the data enable signal from the data enable signal generation portion and provides first and twelfth output signals; a fourth NAND gate for receiving the third out signal, fourth output signal and the tenth output signal received from the second counter; a fifth NAND gate for receiving the third out signal, the fourth output signal and the sixth output signal received from the second counter; an inverter for inverting the data enable signal received from the data enable signal generation portion; a sixth flip flop which receives the second output signal of the second counter as an input signal and is triggered at a rising edge of the inverted data enable signal from the inverter; a seventh flip flop which receives an output signal of the fourth NAND gate and is triggered at a rising edge of the inverted data enable signal from the inverter to generate an inverted output signal as a reset signal of the second counter; a eighth flip flop which receives output signals of the sixth and seventh flip flops as a preset signal and a clear signal and provides the vertical synchronous signal as an output signal; a ninth flip flop which receives an output signal of the sixth NAND gate and is triggered at a rising edge of the inverted data enable signal; and a tenth flip flop which receives output signals of the ninth and seventh flip flops as a preset signal and a clear signal.

The enable signal generation portion includes an AND gate which receives the data enable synchronous signal from the data enable synchronous signal generation portion and an out signal of the tenth flip flop.

The signal selection portion includes a selection portion for selecting the desired signals of the data enable synchronous signal, horizontal synchronous signal, vertical synchronous signal and the enable signal received from the driving signal generation portion and a transfer portion transferring the selected driving signals from the selection portion and the clock signal received from the clock generation portion.

According to still another aspect of the present invention, there is provided to a circuit for driving a liquid crystal display module (LCM), comprising: a power supply portion for receiving an external 12V to generate an internal voltage of 5V and an internal voltage of 3.3V; a clock generation portion for generating a clock signal CLK of 60 MHz and an inverted clock signal; a driving signal generation portion for receiving the clock signal and the inverted clock signal to generate driving signals of a data enable signal of 1024 CLK, a vertical synchronous signal of 768 H, a horizontal synchronous signal, and an enable signal; a signal selection portion for selecting the desired signals of the driving signals according to a operation mode of the LCM and providing the selected driving signals and the clock signal from the clock generation portion; a state detection portion for receiving the vertical synchronous signal and the external voltage of 5 to detect an operation state of the LCD driving circuit; a power selection portion for selecting the external voltage of 5V or the external voltage of 12V according to the application of the internal voltage of 5V; and an output portion for outputting the selected driving signals and the clock signal received from the signal selection portion, the power voltage selected from the power selection portion, and a state detection signal received from the state detection portion.

The driving signal generation portion includes: a counting portion which is triggered at a falling edge of the inverted clock signal from the clock generation portion to count the clock signal; a data enable signal generation portion for receiving output signals from the counting portion to generate the data enable signal of 1024 CLK; a horizontal synchronous signal generation portion for receiving the output signals from the counting portion to generate the horizontal synchronous signal; a vertical synchronous signal generation portion for receiving the data enable signal from the data enable signal generation portion to generate the vertical synchronous signal of 768 H; an enable signal generation portion for receiving the data enable signal and the vertical synchronous signal to the enable signal; and a stabilizing means for stabilizing the internal voltage of 5V which is provided to the data enable signal generation portion, vertical synchronous signal generation portion and the horizontal synchronous signal generation portion.

The counting portion includes a first counter which is triggered at a falling edge of the inverted clock signal from the clock generation portion and provides first and twelfth output signals.

The data enable signal generation portion includes: a first NAND gate for receiving the sixth out signal and the eighth output signal received from the first counter;

a second NAND gate for receiving the sixth out signal, the eighth output signal and the tenth output signal received from the first counter; a first flip flop which receives an output signal of the first NAND gate as an input signal and is triggered at a rising edge of the clock signal from the clock generation portion; a second flip flop which receives an output signal of the second NAND gate and is triggered at a rising edge of the clock signal from the clock generation portion to generate its inverted output signal to the first counter of the counting portion as a reset signal; and a third flip flop which receives output signals of the first and second flip flops as a preset signal and a clear signal and generates the data enable signal of 640 CLK as an output signal.

The horizontal synchronous signal generation portion includes: a third NAND gate for receiving the third out signal and the seventh output signal received from the first counter; a fourth flip flop which receives an output signal of the third NAND gate as an input signal and is triggered at a rising edge of the clock signal from the clock generation portion; and a fifth flip flop which receives output signals of the fourth and second flip flops as a preset signal and a clear signal and generates the horizontal synchronous signal as an output signal.

The vertical synchronous signal generation portion includes: a second counter which is triggered at a falling edge of the data enable signal from the data enable signal generation portion and provides first and twelfth output signals; a fourth NAND gate for receiving the second out signal and the third output signal received from the second counter; a first AND gate for receiving the second and third output signals of the second counter; a second AND gate for receiving a sixth output signal and a ninth output signal of the second counter; a fifth NAND gate for receiving output signals of the first and second AND gates; a sixth NAND gate for receiving the second and third output signals and a sixth output signal of the second counter; an inverter for inverting the data enable signal received from the data enable signal generation portion; a sixth flip flop which receives an output signal of the fourth NAND gate as an input signal and is triggered at a rising edge of the inverted data enable signal from the inverter; a seventh flip flop which receives an output signal of the fifth NAND gate and is triggered at a rising edge of the inverted data enable signal from the inverter; a eighth flip flop which receives output signals of the sixth and seventh flip flops as a preset signal and a clear signal and generates the vertical synchronous signal as an output signal; a ninth flip flop which receives an output signal of the sixth NAND gate and is triggered at a rising edge of the inverted data enable signal; and a tenth flip flop which receives output signals of the ninth and seventh flip flops as a preset signal and a clear signal.

The enable signal generation portion includes an AND gate which receives the data enable signal from the data enable signal generation portion and an output signal of the tenth flip flop of the vertical synchronous signal generation portion.

The signal selection portion includes: a selection portion for selecting the desired signals of the data enable synchronous signal, horizontal synchronous signal, vertical synchronous signal and the enable signal received from the driving signal generation portion; and a transfer portion transferring the selected driving signals from the selection portion and the clock signal received from the clock generation portion.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

Figure 1:
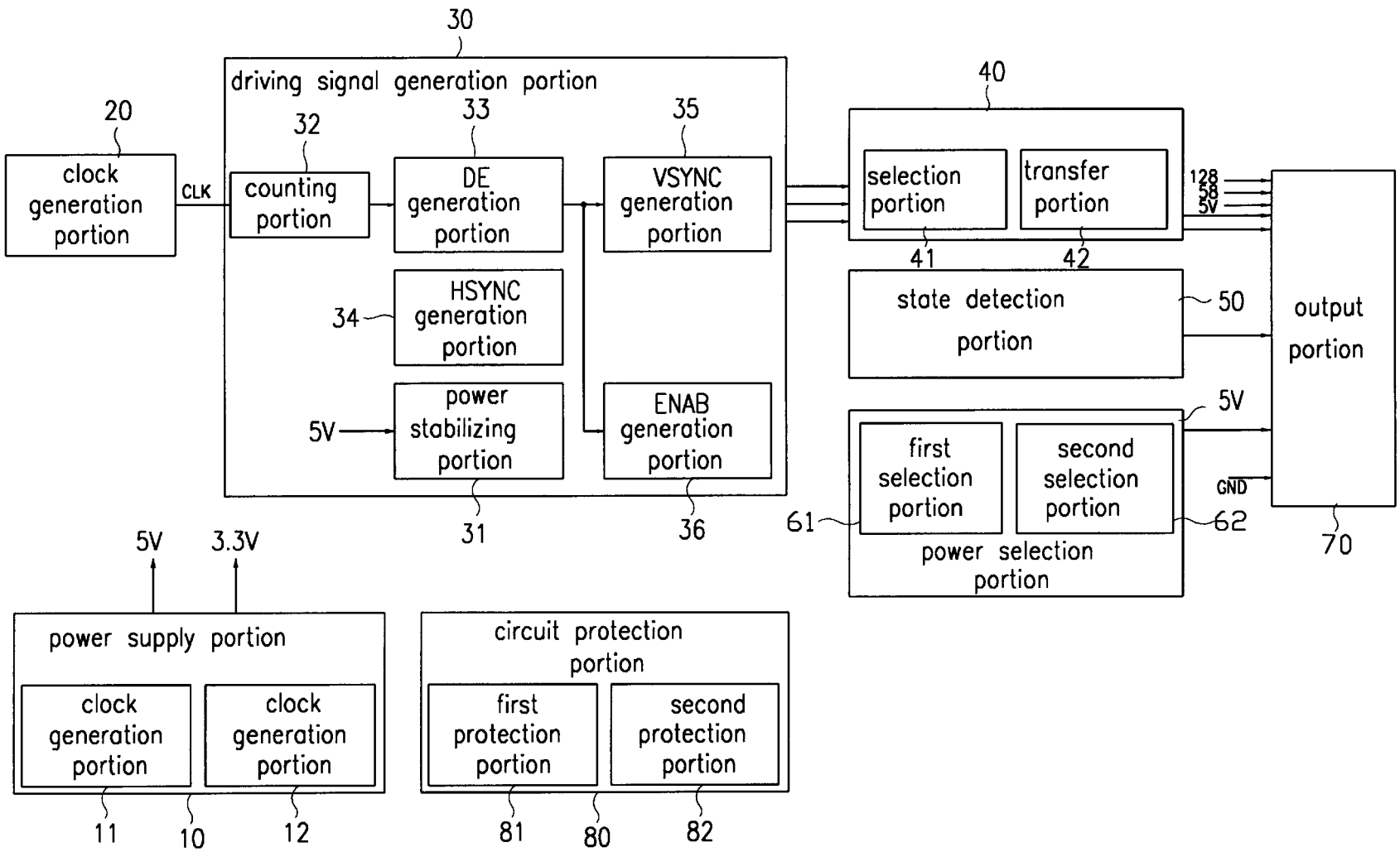
FIG. 1 is a block diagram of a liquid crystal display module (LCM) driving circuit of the present invention.

FIG. 1 is a block diagram of a liquid crystal display module (LCM) driving circuit for aging test of the present invention. The LCM driving circuit includes a power supply portion 10 which receives an external voltage of 12V (12B as shown in drawings) to generate internal voltages of 3.3V and 5V, a clock generation portion 20 for generating a clock signal CLK of a desired frequency, a driving signal generation portion 30 for receiving the clock signal CLK from the clock signal generation portion 20 to generate a driving signal of a data enable signal DE, a horizontal synchronous signal HSYNC, a vertical synchronous signal VSYNC and an enable signal ENAB.

The LCM driving circuit includes a signal selection portion 40 for selecting desired signals of the driving signals and a state detection portion 50 for receiving the vertical synchronous signal VSYNC and the external voltage of 5V to detect a normal operation state of the LCM driving circuit.

The LCM driving circuit includes a power selection portion 60 which selects an external voltage of 5V (5B as shown in drawings) in driving the LCM driving circuit or selects the external voltage of 12V according to application of the internal voltage of 5V (5V as shown in drawings), an output portion 70 for providing power voltages 12B, 5B and 5V, the driving signals selected through the signal selection portion 40 and a state detection signal received from the state detection portion, and a circuit protection portion 80 for selecting the external voltage when the external voltage and the internal voltage are simultaneously applied to the LCM driving circuit so as to protect the circuit.

The power supply portion 10 includes a first generation portion 11 for receiving the external voltage of 12V to generate the internal voltage of 5V and a second generation portion 12 for receiving the external voltage of 12V to generate the internal voltage of 3.3V. In general, there are video graphics array(VGA) having resolution of 640×480, super video graphics array(SVGA) having resolution of 800×600 and extended graphics array(XGA) having resolution of 1024×768 as models of LCM.

Accordingly, the clock generation portion 20 generates the clock signal CLK of a selected frequency with the LCM.

The clock generation portion 20 generates the clock signal of 25.175 MHz for VGA, 40 MHz for SVGA or 65 MHz for XGA.

The driving signal generation portion 30 includes a stabilizing portion 31 for stabilizing the internal voltage of 5V, a counting portion 32 for counting the clock signal CLK received from the clock generation portion 20, a data enable signal generation portion 33 for receiving output signals from the counting portion 32 to generate the data enable signal DE; a horizontal synchronous signal generation portion 34 for receiving output signals of the counting portion 32 to generate the horizontal synchronous signal HSYNC, a vertical synchronous signal generation portion 35 for receiving the data enable signal DE from the data enable signal generation portion 33 to generate the vertical synchronous signal VSYNC and an enable signal generation portion 36 for receiving the vertical synchronous signal VSYNC from the vertical synchronous signal generation portion 35 and the data enable signal DE from the data enable signal generation portion 33 to generate the enable signal ENAB. The signal selection portion 40 includes a selection portion 41 for selecting the desired signals of the driving signals received from the driving signal generation portion 40 and a transfer portion 42 for transferring the selected driving signal through the selection portion 41 to the output portion 80. The state detection portion 50 receives the vertical synchronous signal VSYNC and the external voltage of 5V and detects the normal driving state of the LCM driving circuit.

The power selection portion 60 includes a first selection portion 61 for selecting the external voltage of 5V in driving the LCM according to application of the internal voltage of 5V and a second selection portion 62 for selecting the external voltage of 12V in pattern display according to application of the internal voltage of 5V. The output portion 70 is composed of a connecter for providing output signals of the LCM driving circuit to the interface circuit(not shown in drawings). The circuit protection portion 80 includes a first protection portion 81 for selecting one of two voltages when the internal voltage of 12V and the external voltage of 12V are simultaneously applied and a second protection portion 82 for selecting one of two voltages when the internal voltage of 5V and the external voltage of 5V are simultaneously applied.

The operation of the LCM driving circuit having the above construction will be described in detail hereinbelow. The power supply portion 10 receives the external voltage of 12V and generates the internal voltages of 5V and 3.3V through the first generation portion 11 and the second generation portion 12, respectively. Accordingly, the clock generation portion 20 generates the clock signal CLK of the predetermined frequency to the driving signal generation portion 30 and the signal selection portion 40.

The driving signal generation portion 30 receives the clock signal CLK of the predetermined frequency from the clock generation portion 20. The counting portion 32 counts the clock signal CLK received from the clock generation portion 20, and the data enable signal generation portion 33 and the horizontal synchronous signal generation portion 34 receive the output signals from the counting portion 32 to generate the data enable signal DE and the horizontal synchronous signal HSYNC, respectively. The vertical synchronous signal generation portion 35 receives the data enable signal of the data enable signal generation portion 33 to generate the vertical synchronous signal VSYNC, and the enable signal generation portion 36 receives the enable signal DE of the data enable signal generation portion 33 to generate the enable signal ENAB. At this time, the power stabilizing portion 31 stabilizes the internal voltage of 5V and provides the stabilized voltage to the data enable signal generation portion 33, the horizontal synchronous signal generation portion 34 and the vertical synchronous signal generation portion 35.

The signal selection portion 40 selects the desired signals of the data enable signal DE, horizontal synchronous signal HSYNC, vertical synchronous signal VSYNC and enable signal ENAB received from the driving signal generation portion 30 through the selection portion 41 and transfers the selected driving signals and the clock signal received from the clock generation portion 20 to the output portion 70 through the transfer portion 42.

The state detection portion 50 receives the vertical synchronous signal VSYNC from the vertical synchronous signal generation portion 35 and the external voltage of 5V and detects whether the LCM driving circuit is normally operated, or not to generate the state detection signal to the output portion 70. The power selection portion 60 selects the external voltage of 5V and 0V through the first and second selection portions 61 and 62 to the output portion 70 in application of the internal voltage of 5V, while it selects 0V and the external voltage of 12V through the first and second selection portions 61 and 62 to the output portion 70 in non-application of the internal voltage of 5V.

Figure 2:
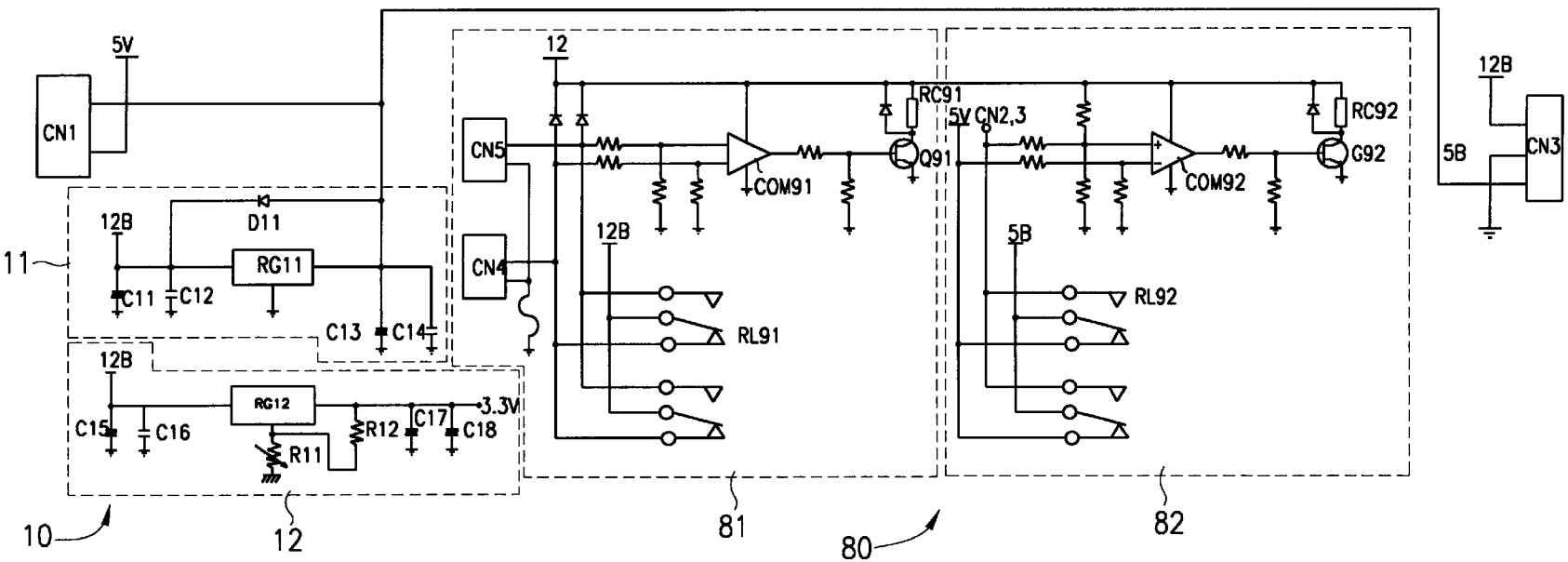
FIG. 2 and FIG. 3 are detailed diagram of the LCM driving circuit in accordance with one embodiment of the present invention.
Figure 3:
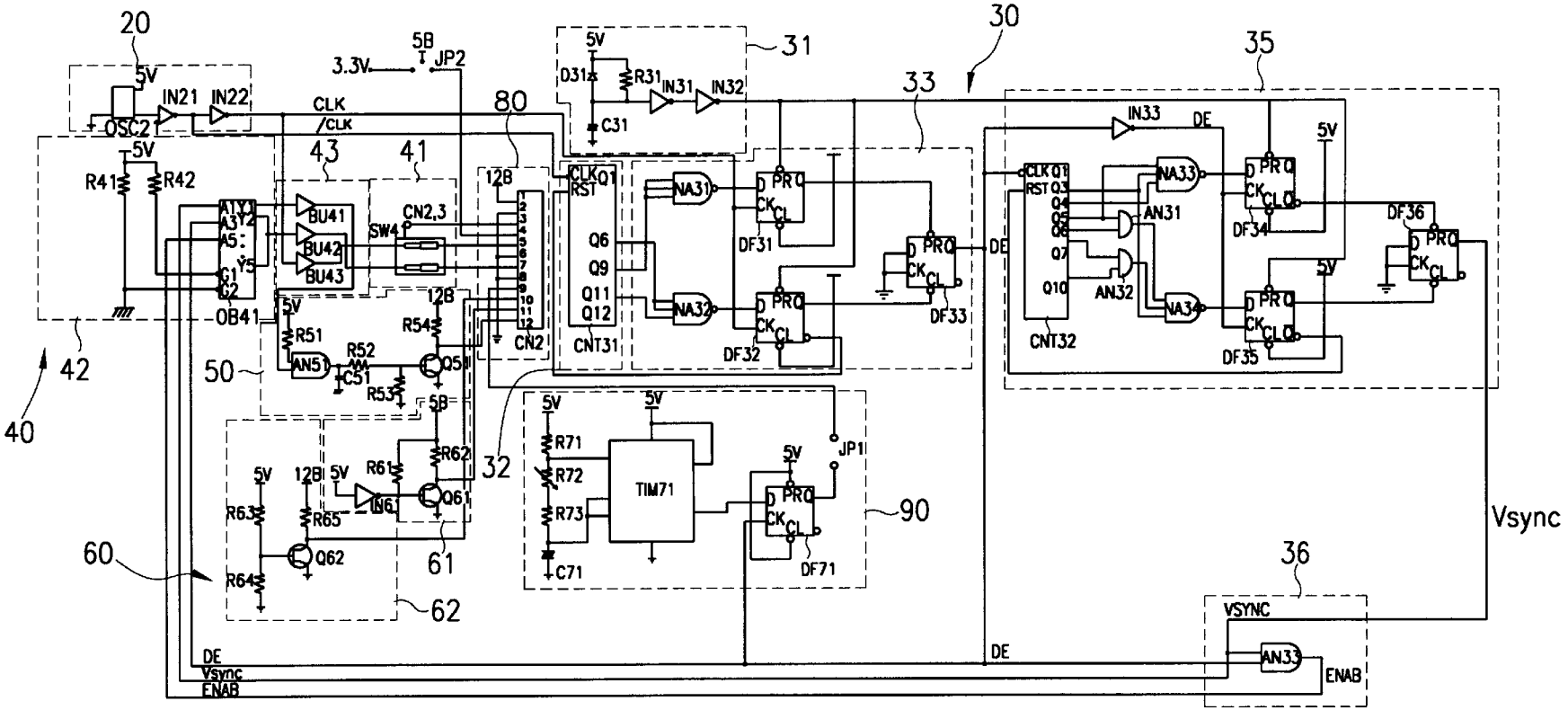

FIG. 2 and FIG. 3 are detailed circuit diagrams of the LCM driving circuit in accordance with one embodiment of the present invention. The LCM driving circuit is an aging test circuit of the LCM for SVGA having resolution of 800×600, which generates a clock signal CLK of 40 MHz and an inverted clock signal /CLK, a data enable signal DE of 800 CLK, a vertical synchronous signal VSYNC of 600 H (horizontal period) and an enable signal ENAB of a composite synchronous signal. The LCM driving circuit of one embodiment includes a power supply portion 10 which receives an external voltage of 12V to generate internal voltages of 3.3V and 5V, a clock generation portion 20 for generating a clock signal CLK of 40 MHz, a driving signal generation portion 30 for receiving the clock signal CLK from the clock signal generation portion 20 to generate a driving signal of a data enable signal DE, a vertical synchronous signal VSYNC and an enable signal ENAD.

Referring to FIG. 2, the power supply portion 10 includes a first generation portion 11 for receiving the external voltage of 12V to generate the internal voltage of 5V, which comprises a regulator RG11, condensers C11–C14 and a diode D11 and a second generation portion 12 for receiving the external voltage of 12V to generate the internal voltage of 3.3V, which comprises a regulator RG12, condensers C15–C18 and resistors R11 and R12. The power supply portion further includes a connector CN1 for selectively providing the internal voltage of 5V generated from the first generation portion 11 to the LCM driving circuit. Referring to FIG. 3, the clock generation portion 20, in which the internal voltage of 5V is supplied by an oscillator thereof, generates the clock signal CLK of 40 MHz and the inverted clock signal /CLK and comprises the oscillator OSC21, a first inverter IN21 for generating the inverted clock signal and a second inverted IN22 for generating the clock signal of 40 MHz.

The driving signal generation portion 30 includes a power stabilizing portion 31, a counting portion 32, a data enable signal generation portion 33, a vertical synchronous signal generation portion 35 and an enable signal generation portion 36. The power stabilizing portion 31 is for stabilizing the internal voltage of 5V which is supplied to the data enable signal generation portion 33 and the vertical synchronous signal generation portion 35, and comprises a diode D31 and a condenser C31 connected between the internal voltage of 5V and a ground, a resistor connected to the diode D31 in parallel and inverters IN31 and IN32 connected to an anode of the diode D31 and the condenser C31. The counting portion 32 comprises a first 12-state binary ripple counter CNT31 for counting the clock signal CLK received from the clock generation portion 20 to generate first through twelfth output signals Q1–Q12. The first counter CNT31 is triggered at a falling edge of the inverted clock signal /CLK received from the clock generation portion 20 to count the clock signal CLK.

The data enable signal generation portion 33 for receiving output signals from the counting portion 32 to generate the data enable signal DE of 800 CLK, comprises a first NAND gate NA31 for receiving the ninth output signal Q9 of the first counter CNT31, a second NAND gate NA32 for receiving the sixth and the eleventh output signals Q6 and Q11 of the first counter CNT31, a first flip flop DF31 which receives an output signal of the first NAND gate NA31 as an input signal D and is triggered at a rising edge of the clock signal CLK from the clock generation portion 20, a second flip flop DF32 which receives an output signal of the second NAND gate NA32 as an input signal D and is triggered at a rising edge of the clock signal CLK from the clock generation portion 20 to generate an inverted output signal to the first counter as a reset signal, and a third flip flop DF33 which receives output signals of the first and second flip flops DF31 and DF32 as a preset signal PR and a clear signal CL to generate the data enable signal DE of 800 CLK.

The vertical synchronous signal generation portion 35 for receiving output signals of the counting portion 32 to generate the vertical synchronous signal VSYNC, includes a second 12-state binary ripple counter CNT32 which is triggered at a falling edge of the data enable signal DE to count the data enable signal DE and provides first through twelfth output signals Q1–Q12, a third NAND gate NA33 for receiving the third through fifth output signals Q3–Q5 of the second counter CNT31, a first AND gate AN31 for receiving the fifth and sixth output signals Q5 and Q6 of the second counter CNT32, a second AND gate AN32 for receiving the fifth and seventh output signals Q5 and Q7 of the second counter CNT32, a fourth NAND gate NA34 for receiving the third output signal Q3 of the second counter CNT32 and output signals of the first and second AND gates AN31 and AN32.

The vertical synchronous signal generation portion further includes an inverter IN33 for inverting the data enable signal DE received from the data enable signal generation portion 33 and providing an inverted data enable signal /DE, a fourth flip flop DF34 which receives an output signal of the third NAND gate NA33 as an input signal D and is triggered at a rising edge of the inverted data enable signal /DE of the inverted IN31, a fifth flip flop DF35 which receives an output signal of the fourth NAND gate NA34 as an input signal D and is triggered at a rising edge of the inverted data enable signal /DE to generate an inverted output signal to the second counter CNT32 as a reset signal RST, a sixth flip flop DF36 which receives output signals of the fourth and fifth flip flops DF34 and DF35 as a preset signal PR and a clear signal CL to generate the vertical synchronous signal VSYNC of 600 H (horizontal period).

The enable signal generation portion 36 includes a third AND gate AN33 for receiving the vertical synchronous signal VSYNC from the vertical synchronous signal generation portion 35 and the data enable signal DE from the data enable signal generation portion 33 to generate the enable signal ENAB of a composite synchronous signal.

The LCM driving circuit includes a signal selection portion 40 for selecting desired signals of the driving signals and a state detection portion 50 for receiving the vertical synchronous signal VSYNC and the external voltage of 5V to detect a normal operation state of the LCM driving circuit. The signal selection portion 40 includes a transfer portion 42 for transferring the driving signals of the data enable signal DE, vertical synchronous signal VSYNC and enable signal ENAB from the driving signal generation portion 30 and the clock signal from the clock generation portion 20 and a selection portion 41 for selecting the enable signal ENAB of the driving signals and the clock signal from the transfer portion 42 and providing the enable signal and clock signal to the output portion 70.

The transfer portion 42 is comprised of a three-state buffer OB41 which the internal voltage of 5V and ground voltage are applied as control signals thereof and which receives the data enable signal DE, vertical synchronous signal VSYNC and enable signal ENAB from the driving signal generation portion 30 and selects the desired signal of the driving signals according to the control signals and buffers BU41–BU43 for stably transferring the selected signals from the buffer OB41 and the clock signal from the clock generation portion by preventing the overload flowing in the inverse direction. The selection portion 41 comprises a switch SW41 for selecting the enable signal and clock signal from the transfer portion 42.

The state detection portion 50 comprises an AND gate for receiving the vertical synchronous signal VSYNC from the buffer BU41 of the signal selection portion 40 and the external voltage of 5V, a transistor Q51, resistors R51–R54 and a condenser C51 which detect the normal driving state of the LCM driving circuit and generate 0V to 1 12-pin connector CN2 of the output portion 70 in normal operation or the external voltage of 12V to the output portion in abnormal operation according to an output of the AND gate AN51.

The LCM driving circuit includes a power selection portion 60 which selects an external voltage of 5V in driving the LCM driving circuit or selects the external voltage of 12V in pattern display according to application of the internal voltage of 5V from the power supply portion 10 and a circuit protection portion 80 for selecting the external voltage when the external voltage and the internal voltage are simultaneously applied to the LCM driving circuit so as to protect the circuit.

The power selection portion 60 includes a first selection portion 61 for selecting the external voltage of 5V in driving the LCM according to application of the internal voltage of 5V, which comprises an inverter IN61, resistors R61 and R62 and a transistor Q61 and a second selection portion 62 for selecting the external voltage of 12V in pattern display according to application of the internal voltage of 5V, which comprises resistors R63–R65 and a transistor Q62. The circuit protection portion 80 includes a first protection portion 81 for selecting one of two voltage when the internal voltage of 12V through a connector CN5 and the external voltage of 12V through a connector CN4 are simultaneously applied, which comprises a relay RL91, a comparator COM91, a transistor Q91 and resistors and a second protection portion 82 for selecting one of two voltages when the internal voltage of 5V and the external voltage of 5V are simultaneously applied, which comprised a relay RL92, a comparator COM92, a transistor Q92 and resistors.

The LCM driving circuit further includes a pattern selection portion 90 for selecting a black pattern or a black and white pattern, comprising a jumper switch JPl for selecting the black and white pattern; a timer TIM71 for adjusting the period of the black and white pattern selected by the jumper switch JP1; and a flip flop DF71 which receives an output of the timer TIM71 as an input signal and is triggered at a rising edge of the data enable signal DE from the data enable signal generation portion 33 to provide the period of the black and white pattern to the output portion 70. A jumper switch JP2 is for selecting the internal voltage of 3.3V or the external voltage of 5V.

The operation of the LCM driving circuit having the above construction will be described in detail hereinbelow. The power supply portion 10 receives the external voltage of 12V and generates the internal voltages of 5V and 3.3V through the regulators RG11 and RG12. The clock generation portion generates the clock signal CLK of the 40 MHz to the driving signal generation portion 30 and the signal selection portion 40 through the oscillator OSC21.

The driving signal generation portion 30 receives the clock signal CLK of 40 MHz from the clock generation portion 20. The counting portion 32 counts the clock signal CLK received from the clock generation portion 20 through the second counter CNT31 to generate the first through twelfth output signals Q1–Q12 and the data enable signal generation portion 33 receives the ninth output signal of the first counter CNT31 as an input signal D of the flip flop DF31 through the NAND gate NA31. The flip flop DF31 is triggered at a rising edge of the clock signal CLK to generate an output signal of 256 CLK. The flip flop receives the output signal of the NAND gate NA32 which receives the output signals Q6 and Q11 of the first counter CNT31 and is triggered at a rising edge of the lock signal to generate an output signal of 1056 CLK. The D flip flop DF33 receives the output signals of the D flip flops DF31 and DF32 as a preset signal and a clear signal to generate a data enable signal DE of 800 CLK.

The second counter CNT32 of the vertical synchronous signal generation portion 35 counts the data enable signal DE to generate the output signals Q1–Q12. The D flip flop DF34 receives the output signal of the NAND gate NA33 for receiving the output signals Q3, Q4, and Q5 of the second counter CNT32 to generate the output signal of 28 H at a rising edge of the inverted data enable signal /DE.

The D flip flop DF35 receives as an input signal D the output signal of the NAND gate NA34 which receives output signals of the AND gates AN31 and AN32 and is triggered at a rising edge of the inverted data enable signal /DE of 628 H. The D flip flop DF36 which receives the output signals of the flip flops DF34 and DF35 as a preset signal PR and a clear signal CL generates the vertical synchronous signal VSYNC of 628 H.

The enable signal generation portion 36 receives the data enable signal DE of the data enable signal generation portion 33 and the vertical synchronous signal generation portion 35 and generates the enable signal ENAB of 600 H.

The signal selection portion 40 provides the vertical synchronous signal VSYNC to the state detection portion 50 and selects the enable signal ENAB through the switch SW41 to provide same to the output portion 70. The state detection portion 50 detects the operation of the LCM driving circuit by receiving the vertical synchronous signal VSYNC and the external voltage of 5V. The signal generation portion provides 0V (ground voltage) to the connector CN2 by turning on the transistor Q51 by the output signal of the AND gate AN51 in normal operation. The interface receives 0V through the connector CN2 to recognize the normal operation state. While in abnormal operation, the transistor Q51 is turned off by the output signal of the AND gate AN51 to generate the external voltage of 12V and the interface recognizes the abnormal state.

The transistor Q61 is turned on and the transistor Q62 is turned off by application of the internal voltage of 5V through the connector CN1 of the power supply portion 10. The power selection portion 60 provides 0V and the external voltage of 5V to the connector CN2 in driving LCM. While in pattern display, the transistor Q61 is turned off and the transistor Q62 is turned on and the power selection portion 60 provides the external voltage of 12V and 0V to the connector CN2.

The LCM driving circuit can select one of a black pattern or black and white pattern through the pattern selection portion 90. In selecting the black and white pattern by the jumper switch JP1, the pattern selection portion 90 provides its output signal through the jumper switch JP1 to the connector CN2. The period of the black and white pattern is adjusted by the period of the timer TIM71. The LCM driving circuit can select the external voltage of 5V or the internal voltage of 3.3V by using the jumper switch JP2 and provides it to the interface through the connecter CN2.

Figure 4:
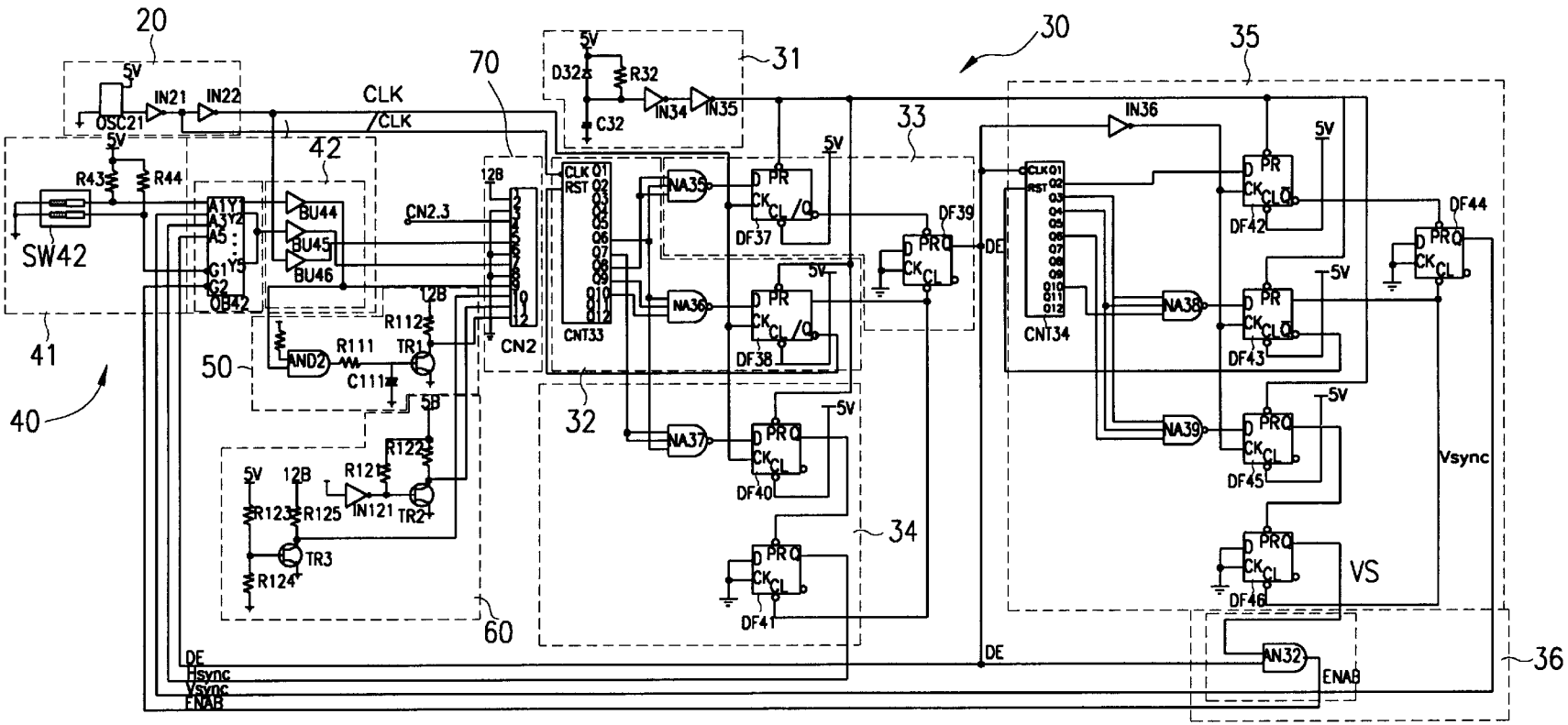
FIG. 4 is a detailed diagram of the LCD driving circuit in accordance with another embodiment of the present invention.

FIG. 4 is a detailed circuit diagram of the LCM driving circuit in accordance with another embodiment of the present invention. The LCM driving circuit is an aging test circuit of the LCM for VGA having resolution of 640×480, which generates a clock signal CLK of 25.175 MHz and an inverted clock signal /CLK, a data enable signal DE of 640 CLK, a first vertical synchronous signal VSYNC of 480 H (horizontal period) for generation of an enable signal, and a second vertical synchronous signal and the enable signal ENAB of a composite synchronous signal. The LCM driving circuit of another embodiment includes a power supply portion (not shown in FIG. 4), a clock generation portion 20 of a socket type, a driving signal generation portion 30, a signal selection 40, a state detection porion 50, a power selection portion 60, an output portion 70 and a circuit protection portion (not shown in FIG. 4). In signal selection portion 40, the selection portion 41 including a switch SW42 is arranged in the preceding of the transfer portion 42 including buffers OB42 and BU44–BU46.

The driving signal generation portion 30 includes a power stabilizing portion 31, a counting portion 32, a data enable signal generation portion 33, a horizontal synchronous signal generation portion 34, a vertical synchronous signal generation portion 35 and an enable signal generation portion 36. The power stabilizing portion 31 is for stabilizing the internal voltage of 5V which is comprised of a diode D32 and a condenser C32 connected between the internal voltage of 5V and a ground, a resistor R32 connected to the diode D32 in parallel and inverters IN33 and IN34 connected to an anode of the diode D32 and the condenser C32. The counting portion 32 comprises a first 125 state binary ripple counter CNT33 for counting the clock signal CLK received from the clock generation portion 20 to generate first through twelfth output signals Q1–Q12. The first counter CNT33 is triggered at a falling edge of the inverted clock signal /CLK received from the clock generation portion 20 to count the clock signal CLK.

The data enable signal generation portion 33 for receiving output signals from the counting portion 32 to generate the data enable signal DE of 640 CLK, comprises a first NAND gate NA35 for receiving the output signals Q6 and Q8 of a first counter CNT33, a second NAND gate NA36 for receiving the output signals Q6, Q9 and Q10 of the first counter CNT33, a first flip flop DF37 which receives an output signal of the first NAND gate NA35 as an input signal D and is triggered at a rising edge of the clock signal CLK from the clock generation portion 20, a second flip flop DF38 which receives an output signal of the second NAND gate NA36 as an input signal D and is triggered at a rising edge of the clock signal CLK from the clock generation portion 20 to generate an inverted output signal to the first counter as a reset signal, and a third flip flop DF39 which receives an inverted output signal /Q of the first flip flop DF37 and an output signal of the second flip flops DF38 as a preset signal PR and a clear signal CL to generate the data enable signal DE of 640 CLK.

The horizontal synchronous signal generation portion 34 for receiving output signals of the counting portion 32 to generate the horizontal synchronous signal HSYNC, a third NAND gate NA37 for receiving the output signals Q6 and Q7 of the first counter CNT33, a fourth D flip flop DF40 which receives an output signal of the third flip flop DF37 as an input signal D and is triggered at a rising edge of the clock signal CLK, a fifth D flip flop DF41 which receives an output signal of the fourth NAND gate NA34 as a preset signal PR and the output signal of the second D flip flop DF38 as a clear signal CL to generate the horizontal synchronous signal HSYNC.

The vertical synchronous signal generation portion 35 for receiving output signals of the counting portion 32 to generate the vertical synchronous signal VSYNC, includes a second counter CNT 34 which is triggered at a falling edge of the data enable signal DE from the data enable signal generation portion 33 and provides first through twelfth output signals Q1–Q12, a fourth NAND gate NA38 for receiving the third output signal, the fourth output signal and the tenth output signal Q3, Q4 and Q10 received from the second counter CNT34, a fifth NAND gate NA39 for receiving the third out signal Q3, the fourth output signal Q4 and the sixth output signal Q6 received from the second counter CNT34, an inverter IN36 for inverting the data enable signal DE received from the data enable signal generation portion 33, a sixth flip flop DF42 which receives the second output signal Q2 of the second counter CNT34 as an input signal and is triggered at a rising edge of the inverted data enable signal /DE from the inverter IN36, a seventh flip flop DF43 which receives an output signal of the fourth NAND gate and is triggered at a rising edge of the inverted data enable signal /DE from the inverter IN36 to generate an inverted output signal as a reset signal of the second counter CNT34, an eighth flip flop DF44 which receives an inverted output signal and an output signal of the sixth and seventh flip flops DF42 and DF43 as a preset signal and a clear signal and provides the first vertical synchronous signal as an output signal, a ninth flip flop DF45 which receives an output signal of the sixth NAND gate NA39 and is triggered at a rising edge of the inverted data enable signal /DE, and a tenth flip flop DF44 which receives output signals of the ninth and seventh flip flops DF46 and DF43 as a preset signal and a clear signal to provide the second vertical synchronous signal vs of 480 H for generation of the enable signal ENAB.

The enable signal generation portion 36 includes an AND gate AN32 which receives the data enable signal DE from the data enable signal generation portion 33 and the second vertical synchronous signal VS of the tenth flip flop DF46 of the vertical synchronous signal generation portion 35. The operation of the LCM driving circuit having the above construction will be described in detail hereinbelow. In the data enable signal generation portion 33, the first flip flop DF37 generates an output signal of 160 CLK and the second D flip flop DF38 generates an output signal of 800 CLK. Therefore the third D flip flop DF39 generates the data enable signal of 640 CLK.

The horizontal synchronous signal generation portion 34 generates the horizontal synchronous signal HSYNC of 704 CLK through the fourth and fifth D flip flops DF40 and DF41. The vertical synchronous signal generation portion 35 generates the first vertical synchronous signal VSYNC of the 522 H and the second vertical synchronous signal VS of 480 H. The enable signal generation portion generates the enable signal by receiving the second vertical synchronous signal VS of 480 H and the data enable signal of 640 CLK.

The signal selection portion selects the vertical synchronous signal VSYNC and the horizontal synchronous signal HSYNC and clock signal CLK in synchronous operation mode or the enable signal ENAB of composite synchronous signal and clock signal.

Figure 5:
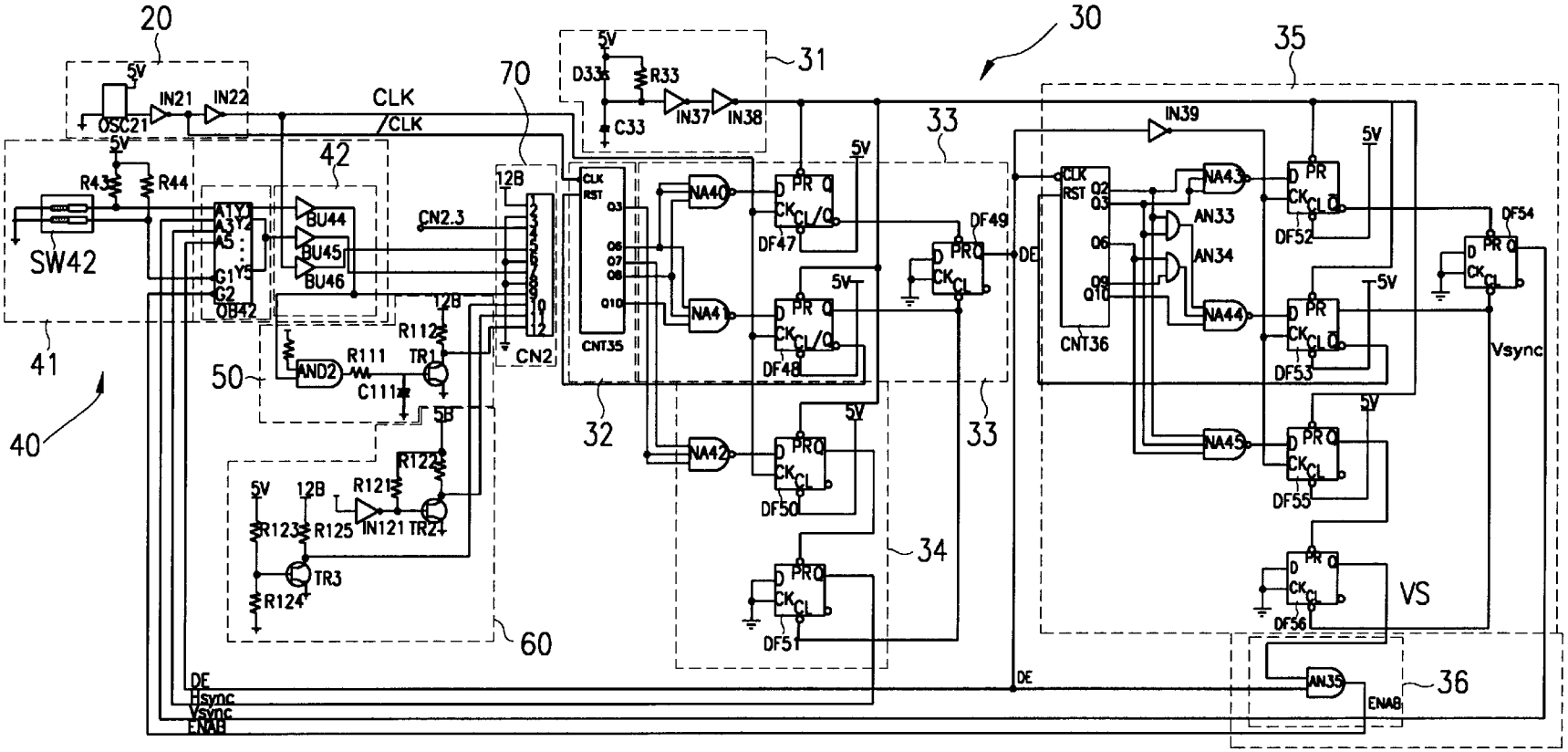
FIG. 5 is a detailed diagram of the LCD driving circuit in accordance with another embodiment of the present invention.

FIG. 5 is a detailed circuit diagram of the LCM driving circuit in accordance with another embodiment of the present invention. The LCM driving circuit is an aging test circuit of the LCM for dual type XGA having resolution of 1024×768, which generates a clock signal CLK of 65 MHz and an inverted clock signal /CLK, a data enable signal DE of 512 CLK, a first vertical synchronous signal VSYNC of 768 H(horizontal period) for generation of an enable signal, and a second vertical synchronous signal and the enable signal ENAB of a composite synchronous signal. The LCM driving circuit of another embodiment includes a power supply portion (not shown in FIG. 5), a clock generation portion 20 of a socket type, a driving signal generation portion 30, a signal selection 40, a state detection porion 50, a power selection portion 60, an output portion 70 and a circuit protection portion (not shown in FIG. 5). In signal selection portion 40, the selection portion 41 including a switch SW42 is arranged in the preceding of the transfer portion 42 including buffers OB43 and BU47–BU49. The driving signal generation portion 30 includes a power stabilizing portion 31, a counting portion 32, a data enable signal generation portion 33, a horizontal synchronous signal generation portion 34, a vertical synchronous signal generation portion 35 and an enable signal generation portion 36. The power stabilizing portion 31 is for stabilizing the internal voltage of 5V which is comprised of a diode D33 and a condenser C33, respectively; connected between the internal voltage of 5V and a ground, a resistor R33 connected to the diode D33, respectively; in parallel and inverters IN37 and IN38 connected to an anode of the diode D33, respectively; and the condenser C33. The counting portion 32 comprises a first 12-state binary ripple counter CNT35 for counting the clock signal CLK received from the clock generation portion 20 to generate first through twelfth output signals Q1–Q12. The first counter CNT35 is triggered at a falling edge of the inverted clock signal /CLK received from the clock generation portion 20 to count the clock signal CLK.

The data enable signal generation portion 33 for receiving output signals from the counting portion 32 to generate the data enable signal DE of 1024 CLK, comprises a first NAND gate NA40 for receiving the output signals Q6 and Q8 of a first counter CNT35, a second NAND gate NA41 for receiving the output signals Q6, Q8 and Q10 of the first counter CNT35, a first D flip flop DF47 which receives an output signal of the first NAND gate NA40 as an input signal D and is triggered at a rising edge of the clock signal CLK from the clock generation portion 20, a D second flip flop DF48 which receives an output signal of the second NAND gate NA41 as an input signal D and is triggered at a rising edge of the clock signal CLK from the clock generation portion 20 to generate an inverted output signal to the first counter CNT35 as a reset signal, and a third D flip flop DF49 which receives an inverted output signal /Q of the first D flip flop DF47 and an output signal of the second D flip flops DF48 as a preset signal PR and a clear signal CL to generate the data enable signal DE of 512 CLK.

The horizontal synchronous signal generation portion 34 for receiving output signals of the counting portion 32 to generate the horizontal synchronous signal HSYNC, includes a third NAND gate NA42 for receiving the output signals Q3 and Q7 of the first counter CNT35, a fourth D flip flop DF50 which receives an output signal of the third NAND gate NA42 as an input signal D and is triggered at a rising edge of the clock signal CLK, a fifth D flip flop DF51 which receives an output signal of the fourth flip flop DF50 as a preset signal PR and the output signal of the second D flip flop DF48 as a clear signal CL to generate the horizontal synchronous signal HSYNC of 664 CLK.

The vertical synchronous signal generation portion 35 for receiving output signals of the counting portion 32 to generate the vertical synchronous signal VSYNC, includes a second counter CNT 36 which is triggered at a falling edge of the data enable signal DE from the data enable signal generation portion 33 and provides first through twelfth output signals Ql–Q12, a fourth NAND gate NA43 for receiving the second out signal Q2 and third output signal Q3 received from the second counter CNT36, a first AND gate AN33 for receiving the output signals Q2 and Q3 of the second counter CNT36, a second AND gate AN34 for receiving the output signals Q6 and Q9 of the second counter CNT36, a fifth NAND gate NA44 for receiving the output, respectively; signals of the AND gates AN33 and AN34, a sixth NAND gate NA45 for receiving the output signals Q2, Q3, and Q6 of the second counter CNT36, an inverter IN39 for inverting the data enable signal DE received from the data enable signal generation portion 33, a sixth flip flop DF52 which receives the output signal of the fourth NAND gate NA43 as an input signal and is triggered at a rising edge of the inverted data enable signal /DE from the inverter IN39, a seventh flip flop DF53 which receives an output signal of the fourth NAND gate NA44 and is triggered at a rising edge of the inverted data enable signal /DE from the inverter IN39 to generate an inverted output signal as a reset signal of the second counter CNT36, an eighth flip flop DF54 which receives an inverted output signal and output signal of the sixth and seventh flip flops DF52 and DF53 as a preset signal and a clear signal and provides the first vertical synchronous signal of 794 H as an output signal, a ninth flip flop DF55 which receives an output signal of the sixth NAND gate NA45 and is triggered at a rising edge of the inverted data enable signal /DE, and a tenth flip flop DF56 which receives output signals of the ninth and seventh flip flops DF55 and DF53 as a preset signal and a clear signal to provide the second vertical synchronous signal VS of 768 H for generation of the enable signal ENAB.

The enable signal generation portion 36 includes an AND gate AN35 which receives the data enable signal DE from the data enable signal generation portion 33 and the second vertical synchronous signal VS of the tenth flip flop DF56 of the vertical synchronous signal generation portion 35.

The operation of the LCM driving circuit having the above construction will be described in detail hereinbelow. In the data enable signal generation portion 33, the first flip flop DF47 generates an output signal of 288 CLK and the second D flip flop DF48 generates an output signal of 800 CLK. Therefore the third D flip flop DF49 generates the data enable signal of 512 CLK.

The horizontal synchronous signal generation portion 34 generates the horizontal synchronous signal HSYNC of 664 CLK through the fourth and fifth D flip flops DF50 and DF51. The vertical synchronous signal generation portion 35 generates the first vertical synchronous signal VSYNC of the 794 H and the second vertical synchronous signal VS of 768 H. The enable signal generation portion generates the enable signal by receiving the second vertical synchronous signal VS of 512 H and the data enable signal of 768 CLK.

The signal selection portion selects the vertical synchronous signal VSYNC and the horizontal synchronous signal HSYNC and clock signal CLK in synchronous operation mode or the enable signal ENAB of composite synchronous signal and clock signal.

In FIG. 3 and FIG. 4, the other portions 20, 30, 50, 60, 70 and 80 have the same construction as those illustrated in FIG. 2 and FIG. 3.

According to the present invention, the LCM driving circuit is capable of generating driving signals for displaying a pattern for aging test regardless of a LCM operation mode. The LCM driving circuit is applicable to an enable mode and a synchronous mode and is capable of providing power supply of 3.3V or 5V to a LCM. The LCM driving circuit generates driving signals capable of displaying black and white patterns at intervals of a desired period.

The foregoing description shows only a preferred embodiment of the present invention. Various modifications are apparent to those skilled in the art without departing from the scope of the present invention which is only limited by the appended claims. Therefore, the embodiment shown and described is only illustrative, not restrictive.

What is claimed is:

1. A circuit for driving an LCM, comprising:

a power supply portion for receiving an external voltage of 12V to generate internal voltages of 3.3V and 5V;

a clock generation portion for generating a clock signal of desired frequency;

a driving signal generation portion for receiving the clock signal from the clock generation portion to generate driving signals, the driving signals including a data enable signal, a horizontal synchronous signal, a vertical synchronous signal, and an enable signal;

a signal selection portion for selecting the desired signals of the driving signals from the driving signal generation portion and outputting the selected driving signals and the clock signal from the clock generation portion;

a state detection portion for receiving the vertical synchronous signal and an external voltage of 5V to detect a normal operation state of the LCM so as to produce a state detection signal;

a power selection portion for selecting a power voltage from one of the external voltage of 5V and the external voltage of 12V in accordance with application of the internal voltage of 5V; and an output portion for outputting the selected driving signals and the clock signal from the signal selection portion, the selected power voltage from the power selection portion and the state detection signal from the state detection portion, wherein the driving signal generation portion includes:

a counting portion for counting the clock signal from the clock generation portion;

a data enable signal generation portion for receiving outputs of the counting portion to generate the data enable signal;

a vertical synchronous signal generation portion for receiving the data enable signal from the data enable signal generation portion to generate the vertical synchronous signal;

a horizontal synchronous signal generation portion for receiving the output signals from the counting portion to generate the horizonital synchronous signal;

an enable signal generation portion for receiving the data enable signal from the data enable signal generation portion and the vertical synchronous signal from the vertical synchronous signal generation portion; and a power stabilizing portion for stabilizing the internal voltage of 5V which is provided to the data enable signal generation portion, the horizontal synchronous signal generation portion and the vertical synchronous signal generation portion.

2. The LCM driving circuit as claimed in claim 1, further comprising a circuit protection portion for protecting the driving circuit by selecting an external voltage when one of the external voltages and one of the internal voltages are simultaneously applied to the driving circuit.

3. The LCM driving circuit as claimed in claim 2, wherein the circuit protection portion includes:

a first protection portion for selecting the external voltage of 12V, when the external voltage of 12V and the internal voltage of 12V are simultaneously applied; and a second protection portion for selecting the external voltage of 5V, when the external voltage of 5V and the internal 5V are simultaneously applied.

4. The LCM driving circuit as claimed in claim 1, wherein the power supply portion includes:

a first generation portion for receiving the external voltage of 12V to generate the internal voltage of 5V; and a second generation portion for receiving the external voltage of 12V to generate the internal voltage of 3.3V.

5. The LCM driving circuit as claimed in claim 1, wherein the signal selection portion includes:

a transfer portion for transferring the driving signals from the driving signal generation portion and the clock signal from the clock generation portion to the output portion; and a selection portion for selecting the desired signals of the driving signals from the driving signal generation portion according to operation mode of the LCM to be transferred to the output portion.

6. The LCM driving circuit as claimed in claim 1, wherein the power selection portion includes:

a first selection portion for providing the external voltage of 5V to the output portion in accordance with application of the internal voltage of 5V from the power supply portion; and a second selection portion for providing the external voltage of 12V to the output portion in accordance with application of the internal voltage of 5V.

7. The LCM driving circuit as claimed in claim 6, wherein the first selection portion includes:

an inverter for detecting application of the internal voltage of 5V from the power supply portion;

a first transistor for providing the external voltage of 5V to the output portion according to a detection result of the inverter; and first and second resistors for supplying the external voltage of 5V to a base and collector of the first transistor, respectively.

8. The LCM driving circuit as claimed in claim 7, wherein the second selection portion includes:

third and fourth resistors for dividing the internal voltage of 5V from the power supply portion; and a second transistor for providing the external voltage of 12V to the output portion in accordance with the divided voltage.

9. The LCM driving circuit as claimed in claim 1, wherein the state detection portion includes:

an AND gate for receiving the vertical synchronous signal from the driving signal generation portion and the internal voltage of 5V from the power supply portion to detect the normal operation state of the LCM; and a transistor for providing a voltage of 0V in normal operation or the external voltage of 12V in abnormal operation to the output portion in accordance with an output of the AND gate.

10. The LCM driving circuit as claimed in claim 1, wherein the clock generation portion generates the clock signal having one of 25.175 MHz, 40 MHz, or 65 MHz.

11. A circuit for driving an LCM, comprising:

a power supply portion for receiving an external voltage of 12V to generate internal voltages of 3.3V and 5V;

a clock generation portion for generating a clock signal CLK of 65 MHz and an inverted clock signal;

a driving signal generation portion for receiving the clock signal from the clock generation portion to generate driving signals, the driving signals including a data enable signal of 800 CLK a vertical synchronous signal of 600 H, and an enable signal:

a signal selection portion for selecting the desired signals of the driving signals from the driving signal generation portion and outputting the selected driving signals and the clock signal from the clock generation portion;

a state detection portion for receiving the vertical synchronous signal and an external voltage of 5V to detect a normal operation state of the LCM so as to produce a state detection signal;

a power selection portion for selecting a power voltage from one of the external voltage of 5V and the external voltage of 12V in accordance with application of the internal voltage of 5V;

a pattern selection portion for selecting one of a black pattern or a black and white pattern as a pattern being displayed on an LCD panel; and an output portion for outputting the selected driving signals and the clock signal from the signal selection portion, the selected power voltage from the power selection portion, the clock signal from the clock generation portion and the state detection signal from the state detection portion, wherein the driving signal generation portion includes:

a counting portion for counting the clock signal from the clock generation portion;

a data enable signal generation portion for receiving outputs of the counting portion to generate the data enable signal of 800 CLK;

a vertical synchronous signal generation portion for receiving the data enable signal from the data enable signal generation portion to generate the vertical synchronous signal of 600 H;

an enable signal generation portion for receiving the data enable signal from the data enable signal generation portion and the vertical synchronous signal from the vertical synchronous signal generation portion to generate the enable signal; and a power stabilizing portion for stabilizing the internal voltage of 5V which is provided to the data enable signal generation portion, and the vertical synchronous signal generation portion.

12. The LCM driving circuit as claimed in claim 11, wherein the counting portion is comprised of a first counter which is triggered at a falling edge of the inverted clock signal from the clock generation portion to count the clock signal and generate first through twelfth output signals.

13. The LCM driving circuit as claimed in claim 12, wherein the data enable signal generation portion includes:

a first NAND gate for receiving the ninth output signal of the first counter;

a second NAND gate for receiving the sixth and eleventh output signals of the first counter;

a first flip flop which receives an output signal of the first NAND gate as an input signal and is triggered at a rising edge of the clock signal from the clock generation portion;

a second flip flop which receives an output signal of the second NAND gate as an input signal, is triggered at a rising edge of the clock signal and provides its inverted output signal to the first counter as a reset signal; and a third flip flop which receives output signals of the first and second flip flops as a preset signal and a clear signal, respectively, and generates the data enable signal of 800 CLK as an output signal.

14. The LCM driving circuit as claimed in claim 13, wherein the vertical synchronous signal generation portion includes:

a second counter which is triggered at a falling edge of the data enable signal received from the data enable signal generation portion to count the data enable signal and generates first through twelfth output signals;

a third NAND gate for receiving the third through fifth output signals of the second counter;

a first AND gate for receiving the fifth and sixth output signals of the second counter;

a second AND gate for receiving the seventh and tenth output signals of the second counter;

a fourth NAND gate for receiving output signals of the first and second AND gates and the third output signals of the second counter;

an inverter for inverting the data enable signal generated from the data enable signal generation portion;

a fourth flip flop which receives an output signal of the third NAND gate as an input signal and is triggered at a rising edge of an inverted data enable signal received from the inverter;

a fifth flip flop which receives an output signal of the fourth NAND gate as an input signal and is triggered at a rising edge of the inverted data enable signal; and a sixth flip flop which receives output signals of the fourth and fifth flop flops as a preset signal and a clear signal, respectively, and generates the vertical synchronous signal of 600 H as an output signal.

15. The LCM driving circuit as claimed in claim 14, wherein the enable signal generation portion includes a third AND gate for receiving the data enable signal from the data enable signal generation portion and the vertical synchronous signal from the vertical synchronous signal generation portion.

16. The LCM driving circuit as claimed in claim 11, wherein the signal selection portion includes;

a transfer portion for transferring the data enable signal, the vertical synchronous signal and the enable signal from the driving signal generation portion and the clock signal from the clock generation portion; and a selection portion for selecting the enable signal and clock signal from the transfer portion to be transferred to the output portion.

17. The LCM driving circuit as claimed in claim 16, wherein the transfer portion includes:

an output buffer for receiving the data enable signal, the vertical synchronous signal and the enable signal from the driving signal generation portion; and a plurality of buffers for protection for transferring the enable signal and the vertical synchronous signal from the output buffer and the clock signal from the clock generation portion.

18. The LCM driving circuit as claimed in claim 17, wherein the selection portion comprises a switch for selecting the enable signal and clock signal received from the transfer portion.

19. The LCM driving circuit as claimed in claim 11, wherein the pattern selection portion includes:

a jumper switch for selecting the black and white pattern;

a timer for adjusting the period of the black and white pattern selected by the jumper switch; and a flip flop which receives an output of the timer as an input signal and is triggered at a rising edge of the data enable signal from the data enable signal generation portion to provide the period of the black and white pattern to the output portion.

20. A circuit for driving a liquid crystal display module (LCM), comprising:

a power supply portion for receiving an external voltage of 12V to generate an internal voltage of 5V and an internal voltage of 3.3V;

a clock generation portion for generating a clock signal CLK of 25.175 MHz and an inverted clock signal;

a driving signal generation portion for receiving the clock signal and the inverted clock signal to generate driving signals, the driving signals including a data enable signal of 640 CLK, a vertical synchronous signal of 480 H, a horizontal synchronous signal and an enable signal;

a signal selection portion for selecting the desired signals of the driving signals according to an operation mode of the LCM and providing the selected driving signals and the clock signal from the clock generation portion;

a state detection portion for receiving the vertical synchronous signal and an external voltage of 5V to detect an operation state of the circuit so as to produce a state detection signal;

a power selection portion for selecting a power voltage from the external voltage of 5V or the external voltage of 12V according to the application of the internal voltage of 5V; and an output portion for outputting the selected driving signals and the clock signal received from the signal selection portion, the power voltage selected from the power selection portion, and the state detection signal received from the state detection portion, wherein the driving signal generation portion includes:

a counting portion which is triggered at a falling edge of the inverted clock signal from the clock generation portion to count the clock signal;

a data enable signal generation portion for receiving output signals from the counting portion to generate the data enable signal of 640 CLK;

a horizontal synchronous signal generation portion for receiving the output signals from the counting portion to generate the horizontal synchronous signal;

a vertical synchronous signal generation portion for receiving the data enable signal from the data enable signal generation portion to generate the vertical synchronous signal of 480 H;

an enable signal generation portion for receiving the data enable signal and the vertical synchronous signal to generate the enable signal; and a stabilizing means for stabilizing the internal voltage of 5V which is provided to the data enable signal generation portion, the vertical synchronous signal generation portion and the horizontal synchronous signal generation portion.

21. The LCM driving circuit as claimed in claim 20, wherein the counting portion includes a first counter which is triggered at a falling edge of the inverted clock signal from the clock generation portion and provides first through twelfth output signals.

22. The LCM driving circuit as claimed in claim 21, wherein the data enable signal generation portion includes:

a first NAND gate for receiving the sixth output signal and the eighth output signal received from the first counter;

a second NAND gate for receiving the sixth output signal, the ninth output signal and the tenth output signal received from the first counter;

a first flip flop which receives an output signal of the first NAND gate as an input signal and is triggered at a rising edge of the clock signal from the clock generation portion;

a second flip flop which receives an output signal of the second NAND gate and is triggered at a rising edge of the clock signal from the clock generation portion to generate its inverted output signal to the first counter of the counting portion as a reset signal; and a third flip flop which receives output signals of the first and second flip flops as a preset signal and a clear signal and generates the data enable signal of 640 CLK as an output signal.

23. The LCM driving circuit as claimed in claim 22, wherein the horizontal synchronous signal generation portion includes:

a third NAND gate for receiving the sixth output signal and the seventh output signal received from the first counter;

a fourth flip flop which receives an output signal of the third NAND gate as an input signal and is triggered at a rising edge of the clock signal from the clock generation portion; and a fifth flip flop which receives an output signal of the fourth flip flop and the output signal of the second flip flop as a preset signal and a clear signal and generates the horizontal synchronous signal as an output signal.

24. The LCM driving circuit as claimed in claim 23, wherein the vertical synchronous signal generation portion includes:

a second counter which is triggered at a falling edge of the data enable signal from the data enable signal generation portion and provides first through twelfth output signals;

a fourth NAND gate for receiving the third output signal, the fourth output signal and the tenth output signal received from the second counter;

a fifth NAND gate for receiving the third output signal, the fourth output signal and the sixth output signal received from the second counter;

an inverter for inverting the data enable signal received from the data enable signal generation portion;

a sixth flip flop which receives the second output signal of the second counter as an input signal and is triggered at a rising edge of an inverted data enable signal from the inverter;

a seventh flip flop which receives an output signal of the fourth NAND gate and is triggered at a rising edge of the inverted data enable signal from the inverter to generate an inverted output signal as a reset signal of the second counter;

an eighth flip flop which receives output signals of the sixth and seventh flip flops as a preset signal and a clear signal and provides the vertical synchronous signal as an output signal;

a ninth flip flop which receives an output signal of the sixth NAND gate and is triggered at a rising edge of the inverted data enable signal; and a tenth flip flop which receives an output signal from the ninth flip flop and the output signal of the seventh flip flop as a preset signal and a clear signal.

25. The LCM driving circuit as claimed in claim 24, wherein the enable signal generation portion includes an AND gate which receives the data enable signal from the data enable signal generation portion and an output signal of the tenth flip flop of the vertical synchronous signal generation portion.

26. The LCM driving circuit as claimed in claim 20, wherein the signal selection portion includes:

a selection portion for selecting the desired signals of the data enable synchronous signal, the horizontal synchronous signal, the vertical synchronous signal and the enable signal received from the driving signal generation portion; and a transfer portion for transferring the selected driving signals from the selection portion and the clock signal received from the clock generation portion.

27. A circuit for driving a liquid crystal display module (LCM), comprising:

a power supply portion for receiving an external voltage of 12V to generate an internal voltage of 5V and an internal voltage of 3.3V;

a clock generation portion for generating a clock signal CLK of 60 MHz and an inverted clock signal;

a driving signal generation portion for receiving the clock signal and the inverted clock signal to generate driving signals, the driving signals including a data enable signal of 1024 CLK a vertical synchronous signal of 768 H, a horizontal synchronous signal, and an enable signal;

a signal selection portion for selecting the desired signals of the driving signals according to an operation mode of the LCM and providing the selected driving signals and the clock signal from the clock generation portion;

a state detection portion for receiving the vertical synchronous signal and an external voltage of 5V to detect an operation state of the LCD driving circuit so as to produce a state detection signal;

a power selection portion for selecting a power voltage from the external voltage of 5V or the external voltage of 12V according to the application of the internal voltage of 5V; and an output portion for outputting the selected driving signals and the clock signal received from the signal selection portion, the power voltage selected from the power selection portion, and the state detection signal received from the state detection portion, wherein the driving signal generation portion includes:

a counting portion which is triggered at a falling edge of the inverted clock signal from the clock generation portion to count the clock signal;

a data enable signal generation portion for receiving output signals from the counting portion to generate the data enable signal of 1024 CLK;

a horizontal synchronous signal generation portion for receiving the output signals from the counting portion to generate the horizontal synchronous signal;

a vertical synchronous signal generation portion for receiving the data enable signal from the data enable signal generation portion to generate the vertical synchronous signal of 768 H;

an enable signal generation portion for receiving the data enable signal and the vertical synchronous signal to generate the enable signal; and a stabilizing means for stabilizing the internal voltage of 5V which is provided to the data enable signal generation portion, the vertical synchronous signal generation portion and the horizontal synchronous signal generation portion.

28. The LCM driving circuit as claimed in claim 27, wherein the counting portion includes a first counter which is triggered at a falling edge of the inverted clock signal from the clock generation portion and provides first through twelfth output signals.

29. The LCM driving circuit as claimed in claim 28, wherein the data enable signal generation portion includes:

a first NAND gate for receiving the sixth output signal and the eighth output signal received from the first counter;

a second NAND gate for receiving the sixth output signal, the eighth output signal and the tenth output signal received from the first counter;

a first flip flop which receives an output signal of the first NAND gate as an input signal and is triggered at a rising edge of the clock signal from the clock generation portion;

a second flip flop which receives an output signal of the second NAND gate and is triggered at a rising edge of the clock signal from the clock generation portion to generate its inverted output signal to the first counter of the counting portion as a reset signal; and a third flip flop which receives output signals of the first and second flip flops as a preset signal and a clear signal and generates the data enable signal of 640 CLK as an output signal.

30. The LCM driving circuit as claimed in claim 29, wherein the horizontal synchronous signal generation portion includes:

a third NAND gate for receiving the third output signal and the seventh output signal received from the first counter;

a fourth flip flop which receives an output signal of the third NAND gate as an input signal and is triggered at a rising edge of the clock signal from the clock generation portion; and a fifth flip flop which receives an output signal of the fourth flip flop and the output signal of the second flip flop as a preset signal and a clear signal and generates the horizontal synchronous signal as an output signal.

31. The LCM driving circuit as claimed in claim 30, wherein the vertical synchronous signal generation portion includes:

a second counter which is triggered at a falling edge of the data enable signal from the data enable signal generation portion and provides first through twelfth output signals;

a fourth NAND gate for receiving the second output signal and the third output signal received from the second counter;

a first AND gate for receiving the second and third output signals of the second counter;

a second AND gate for receiving the sixth output signal and the ninth output signal of the second counter;

a fifth NAND gate for receiving output signals of the first and second AND gates;

a sixth NAND gate for receiving the second and third output signals and the sixth output signal of the second counter;

an inverter for inverting the data enable signal received from the data enable signal generation portion;

a sixth flip flop which receives an output signal of the fourth NAND gate as an input signal and is triggered at a rising edge of an inverted data enable signal from the inverter;

a seventh flip flop which receives an output signal of the fifth NAND gate and is triggered at a rising edge of the inverted data enable signal from the inverter;

an eighth flip flop which receives output signals of the sixth and seventh flip flops as a preset signal and a clear signal and generates the vertical synchronous signal as an output signal;

a ninth flip flop which receives an output signal of the sixth NAND gate and is triggered at a rising edge of the inverted data enable signal; and a tenth flip flop which receives an output signal from the ninth flip flop and the output signal of the seventh flip flop as a preset signal and a clear signal.

32. The LCM driving circuit as claimed in claim 31, wherein the enable signal generation portion includes an AND gate which receives the data enable signal from the data enable signal generation portion and an output signal of the tenth flip flop of the vertical synchronous signal generation portion.

33. The LCM driving circuit as claimed in claim 27, wherein the signal selection portion includes:

a selection portion for selecting the desired signals of the data enable synchronous signal, the horizontal synchronous signal, the vertical synchronous signal and the enable signal received from the driving signal generation portion; and a transfer portion for transferring the selected driving signals from the selection portion and the clock signal received from the clock generation portion.

* * * * *